US008813321B2

(12) United States Patent
Kawaguchi

(10) Patent No.: US 8,813,321 B2
(45) Date of Patent: Aug. 26, 2014

(54) BUCKLE

(75) Inventor: Gaku Kawaguchi, Yokohama (JP)

(73) Assignee: Nifco Inc., Yokohama-shi (JP)

( * ) Notice: Subject to any disclaimer, the term of this patent is extended or adjusted under 35 U.S.C. 154(b) by 0 days.

(21) Appl. No.: 13/702,375

(22) PCT Filed: Jun. 6, 2011

(86) PCT No.: PCT/JP2011/062947

§ 371 (c)(1),
(2), (4) Date: Dec. 20, 2012

(87) PCT Pub. No.: WO2011/155449

PCT Pub. Date: Dec. 15, 2011

(65) Prior Publication Data

US 2013/0104352 A1 May 2, 2013

(30) Foreign Application Priority Data

Jun. 7, 2010 (JP) ..... 2010-130563

(51) Int. Cl.
*A44B 11/25* (2006.01)
*A44B 11/26* (2006.01)

(52) U.S. Cl.
CPC ..... *A44B 11/2592* (2013.01); *A44B 11/266* (2013.01)
USPC ..... 24/615; 24/614; 24/625

(58) Field of Classification Search
USPC ..... 24/614–616, 625, 629, 633
See application file for complete search history.

(56) References Cited

U.S. PATENT DOCUMENTS

| | | | | |
|---|---|---|---|---|
| 6,052,875 | A * | 4/2000 | Fudaki | 24/625 |
| 7,100,252 | B2 * | 9/2006 | Anscher | 24/615 |
| 7,111,368 | B2 * | 9/2006 | Matoba | 24/615 |

FOREIGN PATENT DOCUMENTS

| | | |
|---|---|---|
| JP | H06-46509 U | 6/1994 |
| JP | H07-24105 U | 5/1995 |
| JP | 2006-204911 A | 8/2006 |

OTHER PUBLICATIONS

PCT, "International Search Report for PCT/JP2011/062947", Aug. 9, 2011.

* cited by examiner

*Primary Examiner* — Robert J Sandy
*Assistant Examiner* — Abigail Morrell
(74) *Attorney, Agent, or Firm* — Manabu Kanesaka

(57) ABSTRACT

Buckle includes a male member having a pair of arms each having an engaged part, and a flat cylinder-shaped female member having an insertion port into which the pair of arms is inserted and an engaging part engaging the pair of arms. The female member includes a first cylinder side wall and a second cylinder side wall, and an opened port opposed to the insertion port. The pair of arms is not exposed from an edge of the opened port in the state where the engaging part is engaged with the engaged parts, when viewed from a plane opposed to an outer surface of the first cylinder side wall. The pair of arms is exposed from the opened port in the state where the engaging part is engaged with the engaged parts, when viewed from a plane opposed to an outer surface of the second cylinder side wall.

11 Claims, 4 Drawing Sheets

BUCKLE

TECHNICAL FIELD

The present invention relates to a buckle in which a male member is removably coupled to a female member.

BACKGROUND ART

A buckle including a male member and a female member, as described in Patent Document 1 and Patent Document 2, has been conventionally known.

The male member described in Patent Document 1 includes a pair of arms each having an engaged part at its front end, which is symmetric about a plane, and extends from a bottom. The female member includes a flat cylinder-shaped storage part having an insertion port, into which the pair of arms is inserted, to store the pair of arms in the storage part. A through hole that engages with the engaged parts of the male member is formed in an inner surface of the storage part of the female member. In the state where the male member is coupled to the female member, front ends of the arms do not contact a wall surface opposed to the insertion port, and are stored in the storage part.

The female member described in Patent Document 2 includes a flat cylinder-shaped storage part having an insertion port, into which arms are inserted, and engaging parts that engage with the engaged parts of the arms are formed on an outer edge of an opening opposed to the insertion port. In the state where the engaged parts of the male member engaged with the engaging parts of the female member, the front ends of the arms are exposed from the opening opposed to the insertion port.

PRIOR ART DOCUMENTS

Patent Documents

Patent Document 1: Japanese Utility Model Laid-open Publication No. 07-024105

Patent Document 2: Japanese Patent Laid-open Publication No. 2006-204911

SUMMARY OF THE INVENTION

Problems to be Solved by the Invention

In the state where the male member is engaged with the female member in the buckle described in Patent Document 1, front ends of the arms are stored in the storage part. For this reason, when foreign substances enter from the insertion hole or the through hole into the inside of the storage part, such foreign substances may be accumulated in the storage part. As a result of accumulation of the foreign substances in the storage part of the female member, the foreign substances may become an obstacle for insertion of the male member, inhibiting coupling of the male member to the female member.

On the contrary, in the buckle described in Patent Document 2, in the state where the male member is coupled to the female member, the whole of the engaged parts formed near the front ends of the arms are exposed from the opening opposed to the insertion port. For this reason, even when foreign substances enter into the storage part, the foreign substances entering into the storage part are easily pushed out from the opening of the storage part by the front ends of the arms.

However, although the buckle described in Patent Document 2 can push out the foreign substances entering into the storage part from the storage part, the whole of the engaged parts formed near the front ends of the arms are engaged outside the storage part and accordingly, coupling of the male member and the female member may be released due to some unexpected cause.

In consideration of such circumstances, the present invention intends to provide a buckle capable of suppressing accumulation of the foreign substances entering into the female member while preventing coupling of the male member and the female member from being released due to some unexpected cause.

Means for Solving the Problems

To attain this object, a buckle according to the present invention is a buckle including: a male member including a pair of arms each having an engaged part near a front end; and a flat cylinder-shaped female member that includes an insertion port into which the pair of arms is inserted at one cylinder end and an engaging part engaging the pair of arms in a cylinder due to engagement with the engaged parts at the other cylinder end, wherein the female member includes a first cylinder side wall and a second cylinder side wall, the side walls extending in a flattened direction and being opposed to each other, and an opened port opposed to the insertion port at the other cylinder end; the first cylinder side wall is shaped such that the pair of arms is not exposed from an edge of the opened port, which is defined by the first cylinder side wall, in the state where the engaging part is engaged with the engaged parts, when viewed from a plane opposed to an outer surface of the first cylinder side wall; and the second cylinder side wall is shaped such that at least one of the pair of arms is exposed from the opened port defined by the second cylinder side wall in the state where the engaging part is engaged with the engaged parts, when viewed from a plane opposed to an outer surface of the second cylinder side wall.

According to the present invention, the flat cylinder-shaped female member has the opened port opposed to the insertion port. The first cylinder side wall constituting the female member is shaped such that the arms are not exposed from the edge of the opened port when viewed from the plane opposed to the cylinder side wall, while the second cylinder side wall constituting the female member is shaped such that the arms are exposed from the edge of the opened port when viewed from the plane opposed to cylinder side wall. Since the second cylinder side wall is shaped such that the arms are exposed from the opened port, foreign substances entering into the cylinder of the female member are easily discharged from the opened port. In addition, since the first cylinder side wall constituting the female member is shaped such that the arms are not exposed from the opened port, on the side of the first cylinder side wall, portions near the front ends of the pair of arms are shielded against the outside. Therefore, coupling between the male member and the female member is hard to be subjected to external interference. For this reason, accumulation of the foreign substances entering into the female member can be suppressed while preventing coupling between the male member and the female member from being released due to any unexpected cause.

Preferably, according to the present invention, in the opened port, the edge of the second cylinder side wall is more recessed toward the insertion port than the edge of the first cylinder side wall when viewed from the plane opposed to the outer surface of the second cylinder side wall.

In the process of discharging the foreign substances entering into the cylinder of the female member from the opened port, the foreign substances entering into the cylinder of the female member are often pushed out by the arms inserted from the insertion port. In this connection, from the preferred aspect, the opened port is formed such that the edge defined by the second cylinder side wall out of the edge constituting the opened port is recessed toward the insertion port. With such configuration, since the edge of the second cylinder side wall is recessed, the edge defined by the second cylinder side wall becomes closer to the insertion port. As a result, since the foreign substances entering into the cylinder of the female member are easily pushed out by the arms inserted from the insertion port, accumulation of the foreign substances entering into the female member can be further suppressed.

Preferably, according to the present invention, the first cylinder side wall has a first opening edge constituting an edge of the opened port; and the second cylinder side wall has a second opening edge as the engaging part that constitutes an edge of the opened port, and is more recessed toward the insertion port than the first opening edge when viewed from the plane opposed to the second cylinder side wall, and is shaped such that the engaged parts are exposed from the second opening edge in the state where the engaging part is engaged with the engaged parts, when viewed from the plane opposed to the second cylinder side wall.

From this preferred aspect, the edge of the second cylinder side wall out of the edge constituting the opened port has the second opening edge recessed toward the insertion port, and the second opening edge functions as the engaging part. Therefore, as compared to the configuration in which an engaging part is separately formed, the structure of the female member can be made simpler.

Preferably, according to the present invention, the engaged parts are second engaged protrusions protruding toward the second cylinder side wall in the pair of arms, and a width of the second engaged protrusions in the thickness direction of the second cylinder side wall is smaller than a width of the second cylinder side wall.

From this preferred aspect, in the thickness direction of the second cylinder side wall, each second engaged protrusion is thinner than the second cylinder side wall. Therefore, in the state where the engaging part is engaged with the engaged parts, the engaged parts formed on the arms do not protrude from the outer surface of the second cylinder side wall. With such configuration, engagement between the engaged parts formed on the arms and the edge of the second cylinder side wall is harder to be subjected to external interference. As a result, it can be further prevented that coupling between the male member and the female member is released due to any unexpected cause.

Preferably, according to the present invention, the male member further has first engaged protrusions protruding toward the first cylinder side wall in the pair of arms, and is shaped to be symmetric about a plane including the pair of arms; and the female member has a guide groove that extends from the insertion port to the opened port, and guides the engaged parts between the insertion port and the opened port.

From this preferred aspect, the male member is shaped to be symmetric about the plane including the pair of arms, and the female member has the guide groove that guides the engaged parts of the male member between the insertion hole and the opened port. With such configuration, in both cases where one side surface of the male member is arranged on the side of the first cylinder side wall and the male member is engaged with the female member, and where the one side surface of the male member is arranged on the side of the second cylinder side wall and the male member is engaged with the female member, the above-mentioned effects can be obtained. Therefore, while extending the engagement mode between the male member and the female member, it is possible to prevent accumulation of the foreign substances entering into the female member, and prevent engagement between the male member and the female member from being released due to any unexpected cause.

EMBODIMENTS OF THE INVENTION

Figure 1:
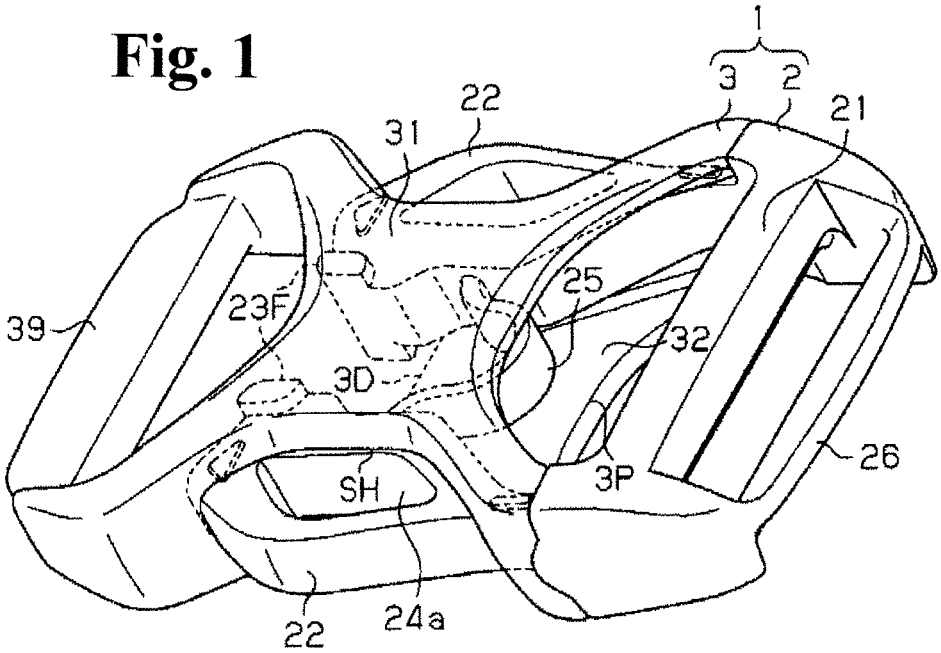
FIG. 1 is a perspective view showing a perspective structure of a buckle in accordance with an embodiment of the present invention when viewed from the front side.

Embodiments of a buckle according to the present invention will be described with reference to drawings. First, the entire structure of the buckle 1 will be described with reference to FIG. 1 and FIG. 2. A bottom 21 of a male member 2 of the buckle 1 has a flexible pair of arms 22 extending from the bottom 21. A female member 3 of the buckle 1 is shaped like a flat cylinder, and has a front wall 31 as a first cylinder side wall and a back wall 32 as a second cylinder side wall, which extend in a flattened direction and are opposed to each other. One cylinder end (right cylinder end in FIG. 1 and FIG. 2) of the female member 3 has an insertion port 3P into which the pair of arms 22 is inserted, and the other cylinder end has an opened port 3D opposed to the insertion port 3P. Hereinafter, a direction from the insertion port 3P to the opened port 3D is defined as an inserting direction, and a direction in which the pair of arms 22 is aligned is defined as a horizontal direction. A side of the front wall 31 in the buckle 1 is defined as a front side, and a side of the back wall 32 in the buckle 1 is defined as a back side.

Figure 3:
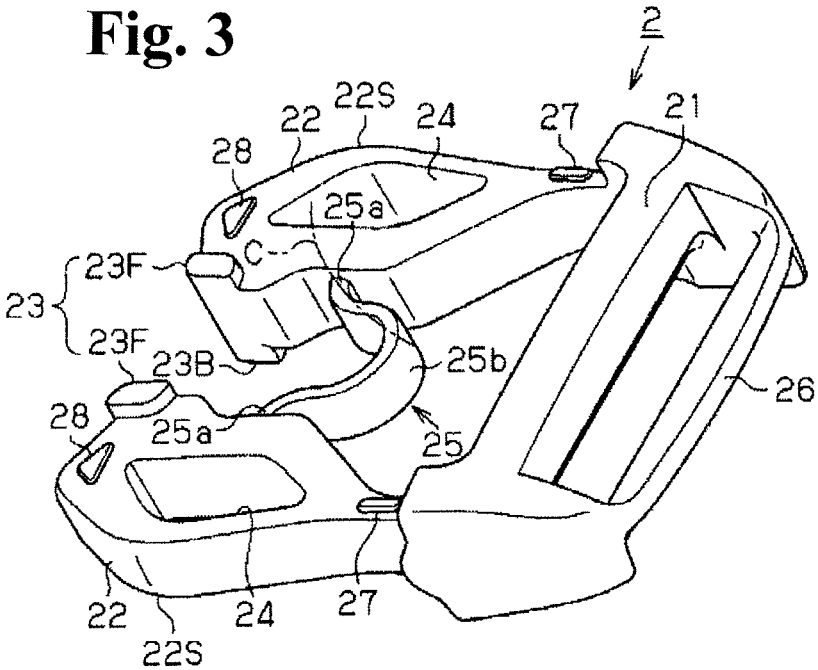
FIG. 3 is a perspective view showing a perspective structure of a male member in accordance with the embodiment when viewed from the front side.
Figure 4:
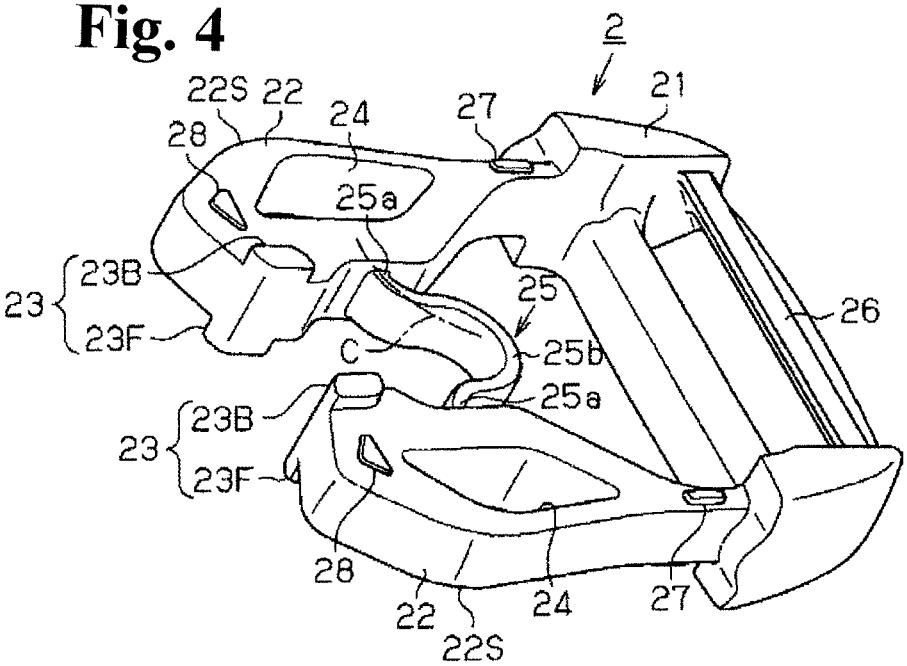
FIG. 4 is a perspective view showing the perspective structure of the male member in accordance with the embodiment when viewed from the back side.

As shown in FIG. 3 and FIG. 4, each of the pair of right and left arms 22 of the male member 2 is expanded toward its front end when viewed from a plane opposed to a plane including the pair of arms 22. Arm engaging parts 22S as intermediate portions of a right outer side surface of the right arm 22 and a left outer side surface of the left arm 22 in the inserting direction are curved so as to protrude outward in the horizontal direction when viewed from the plane opposed to the plane including the pair of arms 22.

The front ends of the pair of arms 22 having the above-mentioned outer shape each have an engaged part 23. The engaged part 23 is composed of a pair of front side protrusions 23F as first engaged protrusions protrudingly formed on front surfaces of the arms 22 and back side protrusions 23B as second engaged protrusions protrudingly formed on back surfaces of the arms 22. An arm hole 24 that has a rhombic cross section and extends in the extending direction of the arms 22 (the inserting direction) is formed near each of the front ends of the pair of the arms 22 so as to penetrate from the front side to the back side of the arm 22. The male member 2 is formed so as to be symmetric about the plane including the pair of arms 22, that is, such that the structure of the pair of arms 22 when viewed from the front side is identical to the structure of the pair of arms 22 when viewed from the back side. Since the above-mentioned arm hole 24 is formed in each of the pair of arms 22, when the male member 2 is formed by, for example, resin molding, the occurrence of shrinkage can be prevented while ensuring the strength of the arms 22.

Bottom end positioning ribs 27 are arranged near bottom ends on the front surface and the back surface of each arm 22, and front end positioning ribs 28 are arranged near front ends on the front surface and the back surface of each arm 22. With such configuration having the positioning ribs, when the male member 2 is coupled to the female member 3, the distance between the outer surfaces of the pair of arms 22 and the inner surface of the female member 3 becomes small especially at places where the bottom end positioning ribs 27 and the front end positioning ribs 28 are formed, that is, at the bottom ends and the front ends of the pair of arms 22. For this reason, in the state where the male member 2 is coupled to the female member 3, misalignment (backlash) of the male member 2 with respect to the female member 3 in the thickness direction of the buckle 1 can be prevented.

A band-like elastic bridge 25 connecting the pair of arms 22 to each other is formed at places that are near the front ends of the arms 22 and is closer to the bottom ends than the engaged parts 23 on opposed inner side surfaces of the pair of arms 22. Each of both ends 25*a* of the bridge 25 extends from one arm 22 to the other arm 22. Describing in detail, in the state where no external force is applied to the arms 22 (state shown in FIG. 3 and FIG. 4), the ends 25*a* of the bridge 25, which are connected to respective arms 22, each are formed so as to conform to a tangent direction of an arc C formed by a connecting portion between the arms 22 and the bridge 25 around the bottom end of the arm 22. An intermediate part 25*b* of the bridge 25 is formed between one arm 22 and the other arm 22 so as to protrude toward the bottom 21. For this reason, even when an excessive external force applied to the pair of arms 22 acts to increase the distance between the pair of arms 22, a shearing force is hard to generate at the connecting portions between the pair of arms 22 and the bridge 25. A belt holding part 26 that holds a belt fastened by the buckle 1 so as to make the length of the belt variable is provided on the bottom 21 on the opposite side of the arms 22.

Figure 5:
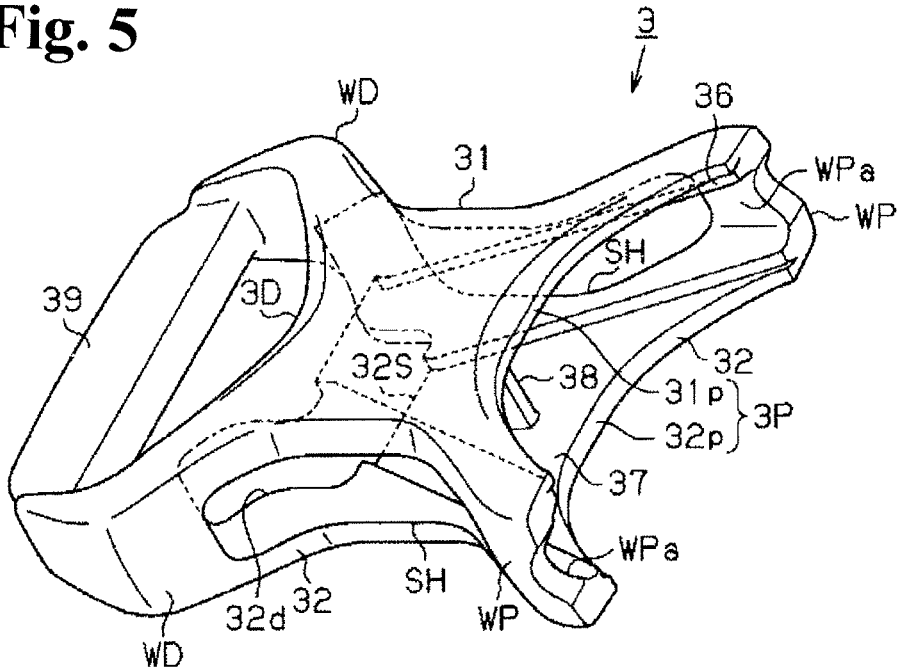
FIG. 5 is a perspective view showing a perspective structure of a female member in accordance with the embodiment when viewed from the front side.
Figure 6:
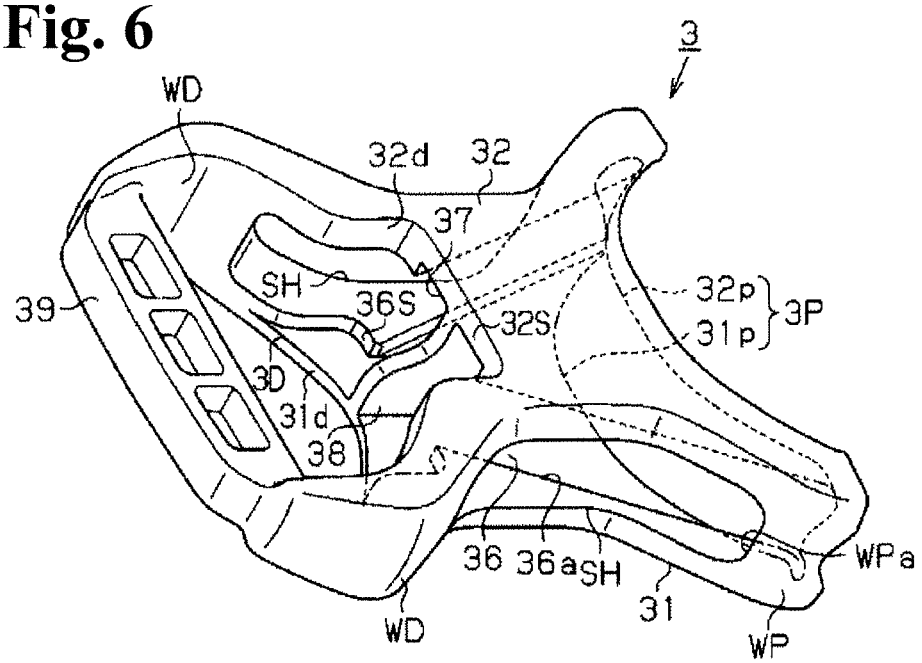
FIG. 6 is a perspective view showing the perspective structure of the female member in accordance with the embodiment when viewed from the back side.

As shown in FIG. 5 and FIG. 6, the front wall 31 of the female member 3 is formed of an X-shaped body surrounded with four curved edges that protrude inward when viewed from the front side. The back wall 32 of the female member 3 is formed of an X-shaped body surrounded with four curved edges that protrude inward when viewed from the back side. At four corners of the front wall 31 and four corners of the back wall 32 of the female member 3, front wall 31 and the back wall 32 are coupled to each other by a pair of insertion-side coupling walls WP near the insertion port 3P and a pair of opened-side coupling walls WD near the opened port. Guide surfaces WPa that align with outer side surfaces at the bottom ends of the pair of arms 22 in the state where the male member 2 is coupled to the female member 3 are formed on inner side surfaces of the pair of insertion-side coupling walls WP. At one cylinder end of the female member 3 in the inserting direction, four sides of the rectangular insertion port 3P when viewed in a direction in parallel to the inserting direction are surrounded with the front wall 31, the back wall 32, and the insertion-side coupling walls WP. At the other cylinder end of the female member 3 in the inserting direction, four sides of the rectangular opened port 3D when viewed in a direction in parallel to the inserting direction are surrounded with the front wall 31, the back wall 32, and the opened-side coupling walls WD.

An opening edge of the insertion port 3P of the female member 3 includes a front side insertion edge 31*p* near the insertion port 3P on the front wall 31, and a back side insertion edge 32*p* near the insertion port 3P on the back wall 32.

The front side insertion edge 31*p* and the back side insertion edge 32*p* are curved so as to protrude toward the opened port 3D, and overlap each other when viewed from a plane opposed to the outer surface of the front wall 31 and the outer surface of the back wall 32. When viewed from the plane outer surface of the front wall 31 and the outer surface of the back wall 32, outer shape of the front wall 31 and the back wall 32 is formed such that the front side insertion edge 31*p* and a front side opening edge 31*d* conform to the outer shape of the pair of arms 22.

In the state where the male member 2 is coupled to the female member 3, the insertion port 3P is formed so as to symmetric about the plane including the pair of arms 22. In the state where the male member 2 is coupled to the female member 3, the front wall 31 is formed such that the pair of arms 22 is not exposed from the edge of the insertion port 3P, which is defined by the front wall 31, when viewed from the plane opposed to the outer surface of the front wall 31. Further, in the state where the male member 2 is coupled to the female member 3, the back wall 32 is formed such that the pair of arms 22 is not exposed from the edge of the insertion port 3P, which is defined by the back wall 32, when viewed from the plane opposed to the outer surface of the back wall 32 (Refer to FIG. 1 and FIG. 2).

With such configuration, in the state where the male member 2 is coupled to the female member 3, the aesthetic aspect based on functional unity of the male member 2 and the female member 3 is enhanced. For the insertion port 3P having such configuration, since the insertion port 3P of the female member 3 and the front ends of the pair of arms 22 are symmetric about a plane, when the male member 2 is coupled to the female member 3, the pair of arms 22 is easily inserted into the insertion port 3P.

An opening edge of the opened port 3D of the female member 3 includes the front side opening edge 31*d* as an edge near the opened port 3D on the front wall 31 and a back side opening edge 32*d* as an edge near the opened port 3D on the back wall 32. The opened port 3D is formed so as to be asymmetric about the plane including the pair of arms 22 in the state where the male member 2 is coupled to the female member 3.

Describing in detail, the front side opening edge 31*d* is curved so as to protrude toward the insertion port 3P. The outer shape of the front wall 31 is formed such that the front side insertion edge 31*p* and the front side opening edge 31*d* conform to the outer shape of the pair of arms 22 when viewed from the plane opposed to the outer surface of the front wall 31. In the state where the male member 2 is coupled to the female member 3, the front wall 31 is formed such that the pair of arms 22 is not exposed from the edge of the opened port 3D, which is defined by the front wall 31, when viewed from the plane opposed to the outer surface of the front wall 31 (Refer to FIG. 1 and FIG. 2). With such configuration, like the insertion port 3P, in the state where the male member 2 is coupled to the female member 3, the aesthetic aspect based on functional unity of the male member 2 and the female member 3 is enhanced.

Like the front side opening edge 31*d*, the back side opening edge 32*d* is also curved so as to protrude toward the insertion port 3P. Moreover, the back side opening edge 32*d* has an engaging edge 32S that is more recessed toward the insertion port 3P than the front side opening edge 31*d* when viewed from the plane opposed to the outer surface of the back wall 32. The engaging edge 32S is composed of a bottom edge as an edge closest to the insertion port 3P, which extends in the horizontal direction, and a pair of side edges extending from both horizontal ends of the bottom edge in the inserting direction, when viewed from the plane opposed to the outer surface of the back wall 32. In the state where the male member 2 is coupled to the female member 3, when viewed from the plane opposed to the outer surface of the back wall 32, the pair of arms 22 is exposed from the edge of the opened port 3D, which is defined by the back wall 32, by the engaging edge 32S.

Figure 2:
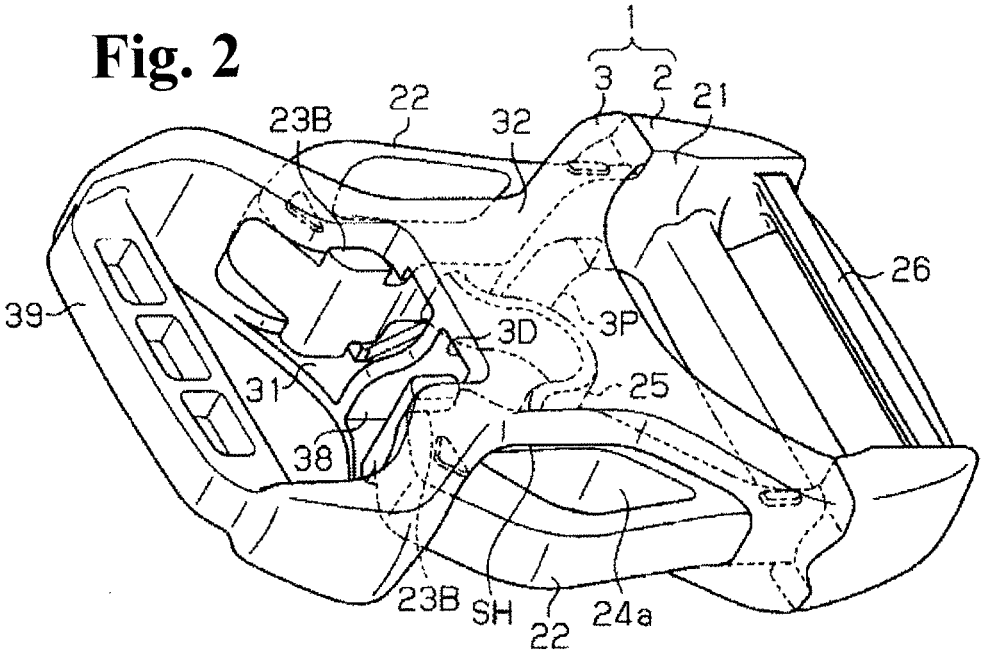
FIG. 2 is a perspective view showing the perspective structure of the buckle in accordance with the embodiment when viewed from the back side.

In the state where the male member 2 is coupled to the female member 3, the back wall 32 is formed such that the bottom edge and the side edges, which constitute the engaging edge 32S, contact the pair of back side protrusions 23B, and only the pair of back side protrusions 23B is exposed from the engaging edge 32S (Refer to FIG. 1 and FIG. 2). In the state where the male member 2 is coupled to the female member 3, the back side protrusions 23B of the pair of arms 22 come into contact with the bottom edge and the side edges of the engaging edge 32S, resulting in that the back side protrusions 23B are hard to move toward the insertion port 3P. With such configuration, since a part of the opened port 3D functions as an engaging part with the back side protrusions 23B, as compared to the configuration in which such engaging part is separately formed, the structure of the female member 3 can be made simpler.

A thickness of the back wall 32 on the engaging edge 32S is larger than a thickness of the back side protrusions 23B. With such configuration, in the state where the back side protrusions 23B are engaged with the engaging edge 32S, the back side protrusions 23B do not protrude from the outer surface of the back wall 32. For this reason, engagement between the back side protrusions 23B formed on the pair of arms 22 and the engaging edge 32S formed on the back wall 32 is hard to be subjected to external interference. As a result, it can be prevented that coupling between the male member 2 and the female member 3 is released due to any unexpected cause.

The inner surface of the front wall 31, as shown in FIG. 6, includes a front side guide groove 36 extending in the inserting direction. The front side guide groove 36 has a front side insertion groove 36*a* having a width that becomes narrower from the front side insertion edge 31*p* toward the opened port 3D at a uniform rate and an engaging groove 36S expanded toward the front side insertion groove 36*a* on the side of the opened port 3D. The side wall constituting the engaging groove 36S is formed to overlap the engaging edge 32S when viewed from the plane opposed to the outer surface of the back wall 32. When the male member 2 is inserted into the female member 3, the front side protrusions 23F of the pair of arms 22 come into slide contact with the side wall of the front side insertion groove 36*a*, and are guided to the engaging groove 36S. Then, in the state where the male member 2 is coupled to the female member 3, the front side protrusions 23F of the pair of arms 22 come into contact with the side wall of the engaging groove 36S, resulting in that the front side protrusions 23F are hard to move toward the insertion port 3P.

The inner surface of the back wall 32, as shown in FIG. 5, includes a back side guide groove 37 extending in the inserting direction. The back side guide groove 37 is formed to have a width that becomes narrower from the back side insertion edge 32*p* toward the engaging edge 32S. A side wall constituting the back side guide groove 37 is formed so as to overlap the front side insertion groove 36*a* when viewed from the plane opposed to the outer surface of the back wall 32. When the male member 2 is inserted into the female member 3, the back side protrusions 23B of the pair of arms 22 come into slide contact with the side wall of the back side guide groove 37, and are guided to the engaging edge 32S.

The female member 3 further includes, in addition to the insertion port 3P and the opened port 3D, a pair of arm insertion holes SH opposed to each other in a direction orthogonal to the inserting direction. The pair of arm insertion holes SH is shaped like a rectangle having four sides surrounded with the front wall 31, the back wall 32, the insertion-side coupling walls WP, and the opened-side coupling walls WD when viewed in a direction parallel to the horizontal direction. Opening edges of the pair of arm insertion holes SH conform to inner circumferential surfaces 24*a* of the arm holes 24 of the pair of arms 22. In the state where the male member 2 is coupled to the female member 3, the arm holes 24 of the pair of arms 22 are exposed to the outside of the female member 3, and the pair of arm insertion holes SH is covered with the arms 22. With such configuration, the shape of the inner circumferential surfaces 24*a* of the arm hole 24 follows the shape of the arm insertion holes SH (Refer to FIG. 1 and FIG. 2). For this reason, foreign substances can be prevented from entering into the female member 3 from the pair of arm insertion holes SH while enhancing the aesthetic aspect based on functional unity of the male member 2 and the female member 3 in the buckle 1.

A partition plate 38 that couples the center of the front side guide groove 36 in the horizontal direction to the center of the back side guide groove 37 in the horizontal direction is formed in the female member 3 so as to extend in the inserting direction. By forming such partition plate 38, bending of the front wall 31 and the back wall 32 in the female member 3 can be prevented. In addition, a belt attachment part 39 to which a belt fastened by the buckle 1 is attached such that the length of the belt cannot be changed is provided at an end of the female member 3 in the inserting direction. The belt attachment part 39 has three closed-end holes to reduce the weight of the buckle 1.

Figure 7A:
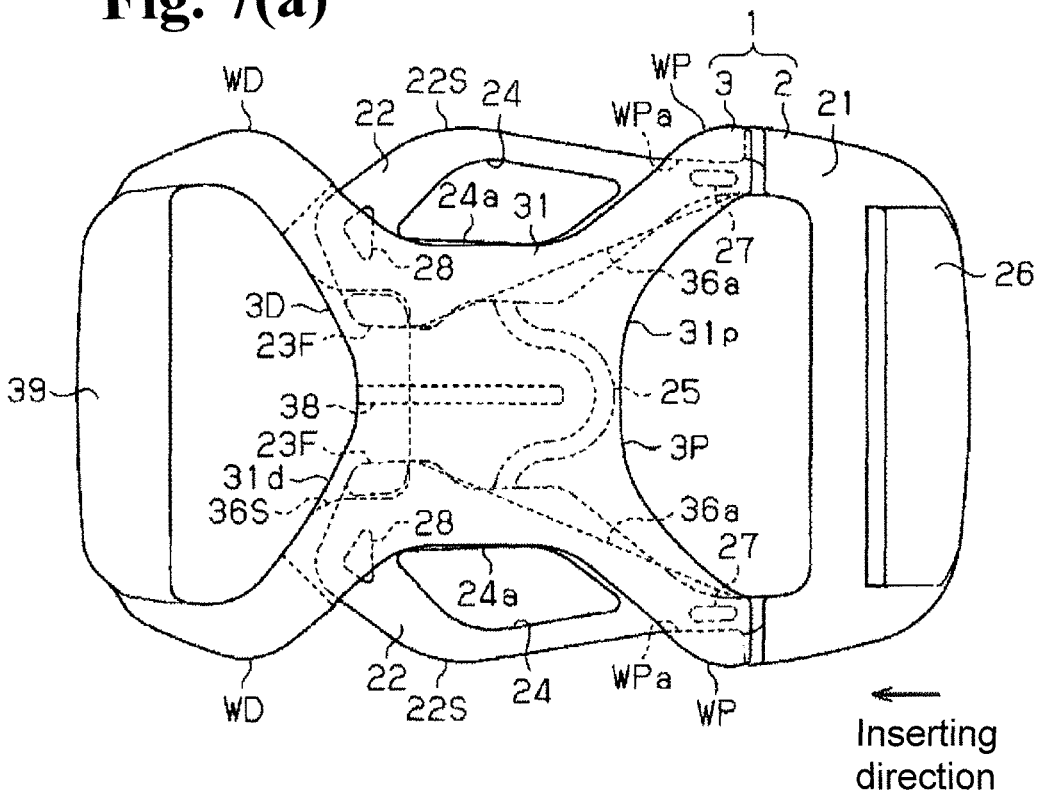
FIG. 7(*a*) is a plan view showing a structure of the buckle in accordance with the embodiment in a plan view when viewed from the front side, and FIG. 7(*b*) is a plan view showing the structure of the buckle in accordance with the embodiment in a plan view when viewed from the back side.
Figure 7B:
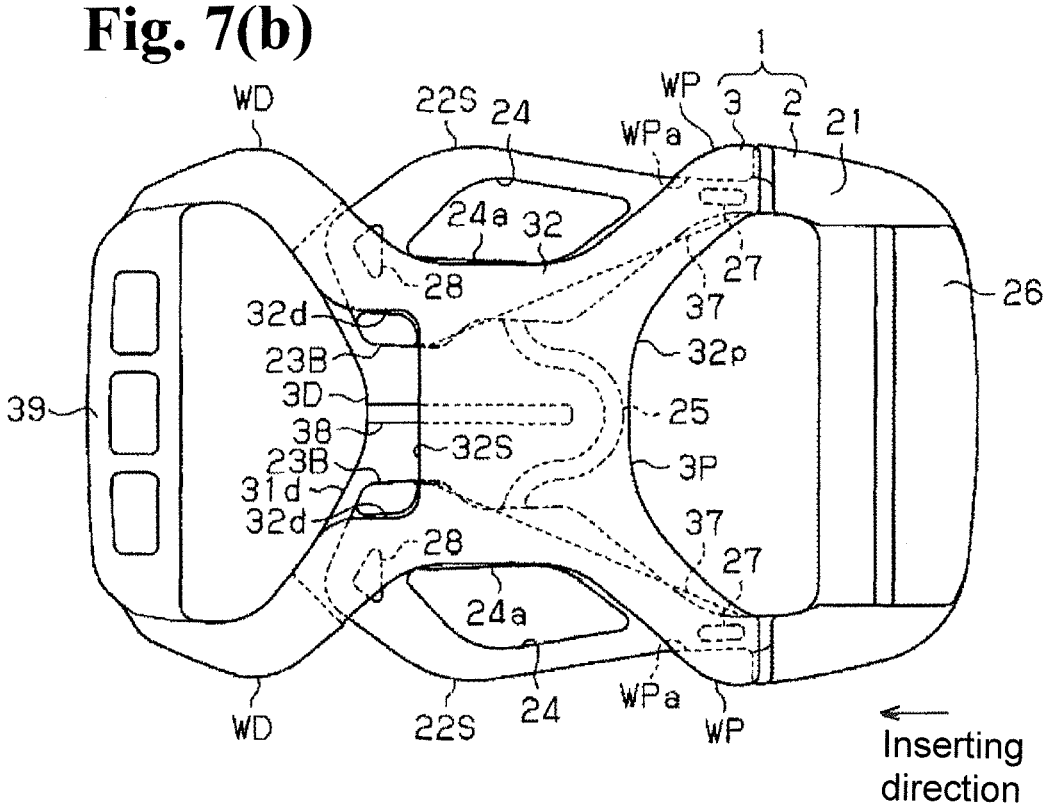

As shown in FIGS. 7(*a*) and 7(*b*), when the pair of arms is inserted from the insertion port 3P in the inserting direction represented by an arrow in these figures, first, the outer side surfaces of the arms 22 slide on the guide surfaces WPa, and the front ends of the pair of arms 22 enter into the female member 3. Next, the pair of front side protrusions 23F protrudingly formed on the front surfaces of the arms 22 is guided to the engaging groove 36S along the front side insertion groove 36*a*. The pair of back side protrusions 23B protrudingly formed on the back surfaces of the arms 22 is guided to the opened port 3D along the back side guide groove 37.

At this time, the outer side surface of each of the pair of arms 22 is formed so as to protrude outward in the horizontal direction in the arm engaging parts 22S. The guide surfaces WPa of the pair of insertion-side coupling walls WP are shaped to match the outer side surfaces at the bottom ends of the pair of arms 22. For this reason, when the pair of arms is inserted into the female member 3, the outer side surfaces of the pair of arms 22 protrude outward than the guide surfaces WPa, and are pushed toward the center in the horizontal direction by the guide surfaces WPa. As a result, when the arm engaging parts 22S are located on the guide surfaces WPa, the pair of arms 22 largely bends toward the center in the horizontal direction. Then, when the arm engaging parts 22S pass the guide surfaces WPa, pressing of the outer side surfaces of the arms 22 by the guide surfaces WPa is released and thus, bending of the pair of arms 22 follows guiding of the front side insertion groove 36*a* and the back side guide groove 37. The width of the front side insertion groove 36*a* and the back side guide groove 37 is set to be smaller than the insertion port 3P toward the opened port 3D at a uniform rate. For this reason, when the pair of arms 22 is inserted under guide of the front side insertion groove 36*a* and the back side guide groove 37, the pair of arms 22 enters into the female member 3 while bending toward the center in the horizontal direction at a uniform rate. With such configuration, since the external force applied to the arms 22 increases once when the arm engaging parts 22S pass the guide surfaces WPa, due to engagement between the arm engaging parts 22S and the guide surfaces WPa, the pair of arms 22 can be temporarily fastened to the female member 3.

When the pair of arms 22 continues to be inserted into the female member 3, the front side protrusions 23F reach the engaging groove 36S, and the back side protrusions 23B reach the opened port 3D. Then, since the engaging groove 36S extends from the front side insertion groove 36*a*, and the engaging edge 32S extends from the back side guide groove 37, the pair of arms 22 bent at the center in the horizontal direction follows the shape of the engaging groove 36S and the engaging edge 32S to extend outward in the horizontal direction. Thereby, the front side protrusions 23F come into contact with the side wall of the engaging groove 36S, resulting in that the front side protrusions 23F are hard to move toward the insertion port 3P. The back side protrusions 23B come into contact with the bottom edge of the engaging edge 32S, resulting in that the back side protrusions 23B are hard to move toward the insertion port 3P. Then, the male member 2 is coupled to the female member 3.

At this time, as shown in FIG. 7(*a*), when viewed from the plane opposed to the outer surface of the front wall 31, the pair of arms 22 is not exposed from the insertion port 3P and the opened port 3D. On the contrary, as shown in FIG. 7(*b*), when viewed from the plane opposed to the outer surface of the back wall 32, the back side protrusions 23B formed near the front ends of the pair of arms 22 are exposed from the opened port 3D. With such configuration, since the arms 22 are exposed from the opened port 3D, with insertion of the pair of arms 22, the foreign substances entering into the cylinder of the female member 3 are easily discharged from the opened port 3D. In addition, since the arms 22 are not exposed from the opened port 3D and thus, the portions near the front ends of the pair of arms 22 are shielded against the outside, engagement between the male member 2 and the female member 3 is hard to be subjected to external interference. For this reason, accumulation of the foreign substances entering into the female member 3 can be suppressed while preventing engagement between the male member 2 and the female member 3 from being released due to any unexpected cause.

As described above, the buckle in accordance with this embodiment can achieve following effects.

(1) The flat cylinder-shaped female member 3 has the insertion port 3P and the opened port 3D opposed to the insertion port. The front wall 31 constituting the female member 3 is formed such that the arms 22 are not exposed from the opened port 3D when viewed from the plane opposed to the front wall 31. The back wall 32 constituting the female member 3 is formed such that the arms 22 are exposed from the opened port 3D when viewed from the plane opposed to the back wall 32.

Therefore, since the back wall 32 is formed such that the arms 22 are exposed from the opened port 3D, the foreign substances entering into the cylinder of the female member 3 are easily discharged from the opened port 3D. In addition, since the front wall 31 is formed such that the arms 22 are not exposed from the opened port 3D, and thus, on the side of the front wall 31, the portions near the front ends of the pair of arms 22 are shielded against the outside, engagement between the male member 2 and the female member 3 is hard to be subjected to external interference. For this reason, accumulation of the foreign substances entering into the female member 3 can be suppressed while preventing engagement between the male member 2 and the female member 3 from being released due to any unexpected cause.

(2) The opened port 3D is formed such that the edge of the back wall 32 is more recessed toward the insertion port 3P than the edge of the front wall 31 when viewed from the plane opposed to the back wall 32. In the process of discharging the foreign substances entering into the cylinder of the female member 3 from the opened port 3D, the foreign substances entering into the cylinder of the female member 3 are often pushed out by the arms 22 inserted from the insertion port 3P. In this connection, in the embodiment, the opened port 3D is formed such that the edge of the back wall 32 out of the edge constituting the opened port 3D is recessed toward the insertion port 3P. Since the edge of the back wall 32 is recessed, in the back wall 32, the opened port 3D gets closer to the insertion port 3P. As a result, since the foreign substances entering into the cylinder of the female member 3 are easily pushed out by the arms 22 inserted from the insertion port 3P, accumulation of the foreign substances entering into the female member 3 can be further suppressed.

(3) The front wall 31 has the front side opening edge 31*d* constituting the edge of the opened port 3D. The back wall has the engaging edge 32S as the engaging part that constitutes the edge of the opened port 3D, and is more recessed toward the insertion port 3P than the front side opening edge 31*d* when viewed from the plane opposed to the back wall 32. In the state where the engaging edge 32S is engaged with the engaged parts 23, the engaged parts 23 are exposed from the engaging edge 32S when viewed from the plane opposed to the back wall 32. With such configuration, the engaging edge 32S constituting the opened port 3D functions as the engaging part with the engaged parts 23. Therefore, as compared to the configuration in which an engaging part is separately formed, the structure of the female member 3 can be made simpler.

(4) The width of the back side protrusions 23B in the thickness direction of the back wall 32 is smaller than that of the back wall 32. With such configuration, in the state where the engaging edge 32S is engaged with the back side protrusions 23B, the back side protrusions 23B formed on the arms 22 do not protrude from the outer surface of the back wall 32. For this reason, engagement between the back side protrusions 23B formed on the arms 22 and the engaging edge 32S is harder to be subjected to external interference. As a result, it can be further prevented engagement between the male member 2 and the female member 3 from being released due to any unexpected cause.

(5) The male member 2 further includes front side protrusions 23F protruding toward the front wall 31 in the pair of arms 22, and is shaped to be symmetric about a plane including the pair of arms 22. The female member 3 has a front side guide groove 36 that extends from the insertion port 3P to the opened port 3D and guides the front side protrusions 23F between the insertion port 3P and the opened port 3D, and a back side guide groove 37 that guides the back side protrusions 23B. The engaging edge 32S of the opened port 3D of the back wall 32 engages with either the front side protrusions 23F or the back side protrusions 23B. With such configuration, in both cases where one side surface of the male member 2 is arranged on the side of the front wall 31 and the male member 2 is engaged with the female member 3, and where the one side surface of the male member 2 is arranged on the side of the back wall 32 and the male member 2 is engaged with the female member 3, the effects (1) to (4) can be obtained. Therefore, while extending the engagement mode between the male member 2 and the female member 3, it is possible to prevent accumulation of the foreign substances entering into the female member 3, and prevent engagement between the male member 2 and the female member 3 from being released due to any unexpected cause.

The embodiment may be implemented in following examples.

The front side protrusions 23F are formed near the front ends of the pair of arms 22 on the front side, and the back side protrusions 23B are formed near the front ends of the pair of arms 22 on the back side. In place of this, the male member 2 may be engaged with the female member 3 only at the back side protrusions 23B and the engaging edge 32S, that is, the front side protrusions 23F may be omitted. With such configuration, in addition to the front side protrusions 23F, the front side guide groove 36 may be omitted. For this reason, the structures of the male member 2 and the female member 3 can be simplified while obtaining effects equivalents to the effects (1) to (4).

The male member 2 may be engaged with the female member only at the front side protrusions 23F and the engaging groove 36S, that is, the back side protrusions 23B may be omitted. With such configuration, in addition to the back side protrusions 23B, the back side guide groove 37 may be omitted. For this reason, the structures of the male member 2 and the female member 3 can be simplified while obtaining effects equivalents to the effects (1) and (2).

A width of the back side protrusions 23B in the thickness direction of the back wall 32 may be that of the back wall 32. With such configuration, the aesthetic aspect based on functional unity of the male member 2 and the female member is enhanced while obtaining the effects (1) to (3). Alternatively, the width of the back side protrusions 23B in the thickness direction of the back wall 32 may be larger than that of the back wall 32. With such configuration, engagement between the back side protrusions 23B and the engaging edge 32S is further ensured while obtaining similar effects to the effects (1) to (3). In the case where the width of the back side protrusions 23B in the thickness direction of the back wall 32 is larger than that of the back wall 32, when the pair of arms 22 slides in the female member 3, the back side protrusions 23B or the pair of arms 22 need to have elasticity that enables contraction in the thickness direction.

The engaging edge 32S of the opened port 3D is composed of the bottom edge extending in the horizontal direction and the side edges extending in the inserting direction. In place of this, for example, the engaging edge 32S may be formed so as to be convex in the inserting direction of the arms 22, or in the detaching direction of the arms 22.

When viewed from the plane opposed to the outer surface of back wall 32, the back side opening edge 32*d* is shaped to be more recessed toward the insertion port 3P than the front side opening edge 31*d*. In place of this, when viewed from the plane opposed to the outer surface of the back wall 32, the back side opening edge 32*d* may be more recessed toward the outside in the horizontal direction than the front side opening edge 31*d*. In summary, the front wall 31 only needs to be shaped such that the pair of arms 22 is not exposed from the opened port 3D when viewed from the plane opposed to the outer surface of the front wall 31, and the back wall 32 only needs to be shaped such that at least one of the pair of arms 22 is exposed from the opened port 3D when viewed from the plane opposed to the outer surface of the back wall 32.

When viewed from the plane opposed to the outer surface of back wall 32, the back side opening edge 32*d* is shaped such that both of the pair of arms 22 are exposed. In place of this, the back side opening edge 32*d* may be shaped such that either of the pair of arms 22 is exposed. Even with such configuration, as long as the portion near the front end of the arm 22 is exposed from the edge of the opened port 3D on the back side, an effect equivalent to the effect (1) can be obtained.

Each of the front side insertion edge 31*p*, the back side insertion edge 32*p*, and the front side opening edge 31*d* is curved to protrude inward in the plan view such that the pair of arms 22 is not exposed. The shape of the front side insertion edge 31*p*, the back side insertion edge 32*p*, and the front side opening edge 31*d* is not limited to such shape, and these edges may be shaped like a straight line extending in the horizontal direction, or may be curved so as to extend outward in the plan view. In summary, the front side insertion edge 31*p*, the back side insertion edge 32*p*, and the front side opening edge 31*d* only need to cover the bottom ends and the front ends of the pair of arms 22 in the plan view.

As shown in FIG. 3 and FIG. 4, although the intermediate part 25*b* of the bridge 25 is curved so as to protrude between one arm 22 and the other the arm 22 toward the bottom 21, the present invention is not limited to this, the intermediate part 25*b* may be curved so as to protrude toward the front ends of the pair of arms 22. In this case, it needs to prevent interference between the partition plate 38 provided in the female member 3 and the bridge 25.

Although the male member 2 is provided with the bridge 25, the present invention is not limited to this, and the bridge 25 needs not be provided. For example, a so-called center bar that protrudes from the bottom 21 in the inserting direction of the arms 22 and guides the male member 2 when the arms 22 are inserted into the female member 3 may be provided between the pair of arms 22. Also in this case, an external force to increase the distance between the arms 22 is hard to act onto the arms 22. In this case, in place of the partition plate 38, a center bar guiding part that guides the center bar needs to be arranged at a position where the partition plate 38 has been provided in the female member 3.

Even with the configuration in which the bottom end positioning ribs 27 or the front end positioning ribs 28 are omitted, similar effects to the above-mentioned effects (1) to (5) can be achieved. As long as a convex rib is formed on the inner side surface of the female member 3, and the pair of arms is pressed by the convex rib in the state where the male member 2 is coupled to the female member 3, even when the bottom end positioning ribs 27 and the front end positioning ribs 28 are omitted, backlash of the male member 2 can be reduced.

In the pair of arms 22, the arm hole 24 may be omitted. Even in this case, the arms 22 can prevent the foreign substances from entering from the side surface of the flat cylinder-shaped female member 3, that is, the arm insertion holes SH.

Although the partition plate 38 is provided, the present invention is not limited to this, and the partition plate 38 may be omitted.

Although the belt attachment part 39 is provided with the three closed-end holes, the present invention is not limited to this, and any number of closed-end holes may be provided or the closed-end hole need not be provided.

A belt holding part 26 that holds the belt fastened by the buckle 1 such that the length of the belt can be changed may be formed on the female member 3, and a belt attachment part 39 to which the belt is attached such that the length of the belt cannot be changed may be formed on the male member 2. In this manner, the length of the belt at fastening of the buckle 1 can be changed.

The whole contents of Specification, Claims, Figures, and Abstract of Japanese Patent Application No. 2010-130563 filed on Jun. 7, 2010 are cited herein, and incorporated as disclosure of Specification of the present invention.

What is claimed is:

1. A buckle, comprising:

a male member including a pair of arms each having an engaged part near a front end; and a hollow female member including, at one end of the hollow female member, an insertion port into which the pair of arms is inserted, and an engaging part, at the other end of the hollow female member, engaging the pair of arms with the engaged parts, wherein the female member includes a first side wall and a second side wall, extending in a flattened direction and being opposed to each other, an opened port opposed to the insertion port at the other end of the hollow female member, a belt attachment part situated away from the opened port, and an opening located between the belt attachment part and the opened port and directly facing the opened port and communicating therewith;

the first side wall is shaped such that the pair of arms is not exposed from an edge of the opened port defined by the first side wall in a state where the engaging part is engaged with the engaged parts, when viewed from a plane opposed to an outer surface of the first side wall;

the second side wall is shaped such that at least one of the pair of arms is exposed from the opened port defined by the second side wall in the state where the engaging part is engaged with the engaged parts, when viewed from a plane opposed to an outer surface of the second side wall; and the female member is hollow throughout an entire length thereof from the insertion port to the opened port.

2. The buckle according to claim 1, wherein in the opened port, an edge of the second side wall is more recessed toward the insertion port than the edge of the first side wall when viewed from the plane opposed to the outer surface of the second side wall.

3. The buckle according to claim 2, wherein the first side wall has a first opening edge constituting the edge of the opened port; and the second side wall has a second opening edge as the engaging part constituting the edge of the opened port, which is more recessed toward the insertion port than the first opening edge when viewed from the plane opposed to the outer surface of the second side wall, and is shaped such that the engaged parts are exposed from the second opening edge in the state where the engaging part is engaged with the engaged parts, when viewed from the plane opposed to the outer surface of the second side wall.

4. The buckle according to claim 3, wherein the engaged parts are second engaged protrusions protruding toward the second side wall in the pair of arms, and a width of the second engaged protrusions in a thickness direction of the second side wall is smaller than a thickness of the second side wall.

5. The buckle according to claim 4, wherein the male member further includes first engaged protrusions protruding toward the first side wall in the pair of arms, and is shaped to be symmetric about a plane including the pair of arms; and the female member has a guide groove that extends from the insertion port to the opened port, and guides the engaged parts between the insertion port and the opened port.

6. The buckle according to claim 5, wherein the insertion port has a front side insertion edge on the first side wall and a back side insertion edge on the second side wall, the first side wall has the edge of the first side wall at an end part of the opened port on the first side wall, the second side wall has the edge of the second side wall at the end part on a side opposite to the insertion port, and a length from the front side insertion edge to the edge of the first side wall is longer than a length from the back side insertion edge to the edge of the second side wall.

7. The buckle according to claim 6, wherein the second engaged protrusions engage with the edge of the second side wall when the male member and the female member are engaged.

8. The buckle according to claim 2, wherein the insertion port has a front side insertion edge on the first side wall and a back side insertion edge on the second side wall, the first side wall has the edge of the first side wall at an end part of the opened port on the first side wall, the second side wall has the edge of the second side wall at the end part on a side opposite to the insertion port, and a length from the front side insertion edge to the edge of the first side wall is longer than a length from the back side insertion edge to the edge of the second side wall.

9. The buckle according to claim 1, wherein the opened port entirely faces the belt attachment part directly through the opening.

10. A buckle, comprising:

a male member including a pair of arms each having an engaged part near a front end; and a hollow female member including, at one end of the hollow female member, an insertion port into which the pair of arms is inserted, and an engaging part, at the other end of the hollow female member, engaging the pair of arms with the engaged parts, wherein the male member further includes bottom end positioning ribs at bottom ends on a front surface and a back surface of the pair of arms, and front end positioning ribs at front ends on the front surface and the back surface of the pair of arms, the female member includes a first side wall and a second side wall, extending in a flattened direction and being opposed to each other, an opened port opposed to the insertion port at the other end of the hollow female member, a belt attachment part situated away from the opened port, and an opening located between the belt attachment part and the opened port and directly facing the opened port and communicating therewith, the first side wall is shaped such that the pair of arms is not exposed from an edge of the opened port defined by the first side wall in a state where the engaging part is engaged with the engaged parts, when viewed from a plane opposed to an outer surface of the first side wall, the second side wall is shaped such that at least one of the pair of arms is exposed from the opened port defined by the second side wall in the state where the engaging part is engaged with the engaged parts, when viewed from a plane opposed to an outer surface of the second side wall, and the female member is hollow throughout an entire length thereof from the insertion port to the opened port.

11. The buckle according to claim 10, wherein the opened port entirely faces the belt attachment part directly through the opening.

* * * * *